US007699013B1

(12) United States Patent
Kreisel

(10) Patent No.: US 7,699,013 B1
(45) Date of Patent: Apr. 20, 2010

(54) DEPLOYABLE THROUGH-HULL SCOOP

(76) Inventor: Richard John Kreisel, 5305 Bimini Dr., Bradenton, FL (US) 34210

( * ) Notice: Subject to any disclaimer, the term of this patent is extended or adjusted under 35 U.S.C. 154(b) by 0 days.

(21) Appl. No.: 12/250,071

(22) Filed: Oct. 13, 2008

(51) Int. Cl.
*B63B 13/00* (2006.01)

(52) U.S. Cl. ..... 114/197; 114/198

(58) Field of Classification Search .. 114/183 R–183 A, 114/197, 198, 125; 440/88 R, 88 N
See application file for complete search history.

(56) References Cited

U.S. PATENT DOCUMENTS 464,276 A * 12/1891 Delane ..... 222/522
1,761,645 A * 6/1930 Sobolew ..... 114/185
2,989,020 A * 6/1961 Grinnell ..... 114/185
3,040,691 A * 6/1962 Reid ..... 114/185
5,671,906 A * 9/1997 Rosen ..... 251/148

* cited by examiner

*Primary Examiner*—Ajay Vasudeva
(74) *Attorney, Agent, or Firm*—Dorothy S. Morse

(57) ABSTRACT

A water uptake device for directing water flow into a moving boat that allows the volume and pressure of the water flow entering the device to be adjusted from full force to no flow at all by simple adjustment of how much of its scooping member protrudes beyond its through-hull fitting into the water stream. Water enters the device through an opening in its deployable scooping member, and operator positioning of the scooping member relative to the through-hull fitting, including complete withdrawal of the scoop into the distal end of the through-hull fitting, is remotely accomplished so that the operator can remain at the helm. Multiple devices can be used on the same marine vessel, with all devices mounted on the bottom of its hull, in a standard fashion for through-hull fittings mounted below the waterline. Applications may include the filling of ballast bags for the sport of wakeboarding.

20 Claims, 2 Drawing Sheets

DEPLOYABLE THROUGH-HULL SCOOP

CROSS-REFERENCES TO RELATED APPLICATIONS

None.

BACKGROUND

1. Field of the Invention

This invention relates to water pickup scoops used in marine applications and other devices adapted for directing water flow into a boat, specifically to a deployable water uptake or scooping device attached through the bottom of a boat hull and configured for directing water flow into the boat while it is moving in a forwardly direction, which further allows the volume and pressure of the water flow entering its scooping member to be adjusted from full force to no flow at all by a simple operator adjustment of the distance the scooping member extends beyond the end of the through-hull fitting housing it and into the water stream immediately surrounding the boat. Optionally, the scooping member may have a break-away design to protect the associated boat hull from damage should the scooping member make contact with a Large or immovable underwater object. Applications include, but are not limited to, use in filling ballast bags in a boat to enlarge the wake produced behind the boat for the sport of wakeboarding. Multiple present invention devices can be used on the same marine vessel, according to operator preference or need.

2. Description of the Related Art

From time to time, boaters may desire a temporary flow of water into their moving boat. Such instances include, but are not limited to, fishermen who desire circulating water for their bait, and those using wakeboarding boats with a variable ballast system that have a need to periodically fill tanks or bladders on board with water, while underway, to enlarge the wake produced behind the boat. Bringing a flow of water into a boat for such purposes is typically accomplished with electrically operated centrifugal pumps, which have a much higher operating cost than the simply designed, easily constructed, and easily installed present invention water uptake device. The purpose of the present invention is to provide a lower cost and easily-operated device that can be used to replace the centrifugal pumps, as well as their associated wiring and switches. With present invention use, water is brought into the boat by the forward motion of the boat and enters an opening in the front of the scooping member, which is revealed when the scooping member is in an at-least-partially-deployed position. The scooping member's opening is aligned at all times with the forward direction of boat travel. Water is then redirected from the water stream surrounding the moving boat into the through-hull fitting which supports the scooping member, and is subsequently carried from it to a ballast bag, or other targeted container located within the boat's hull, via independent plumbing connected to the proximal end portion of the through-hull fitting located inside the hull. Unlike through-hull scoop fittings currently available, the volume and pressure of the water flow entering the present invention scoop device can be adjusted from full force to no flow at all by simple adjustment of how far its scooping member protrudes beyond the through-hull fitting housing it and into the water stream immediately surrounding the boat's hull. It is contemplated for deployment and retraction of the present invention scooping member to be accomplished remotely from the boat's helm so that the operator of the boat does not have to leave the helm to make needed adjustments. It is further contemplated for deployment and retraction of the scooping member to be a simple and prompt response to the action taken by the operator at the helm, without the involvement of electrical switches, which along with pumps and associated wiring, are easily corroded in a marine environment. No other apparatus or method is known that functions in the same manner or provides all of the features and advantages of the present invention water uptake device.

BRIEF SUMMARY OF THE INVENTION

It is the primary object of this invention to provide a low-cost and simply deployed water uptake device for directing water flow into a moving wakeboarding boat, or other marine vessel while it is moving in a forwardly direction through the water, which could be used to replace the centrifugal pumps typically employed for this purpose, as well as eliminate the need for the wiring and switches associated with such pumps, all of which are easily corroded in a marine environment and subject to premature failure as a result thereof. It is also an object of this invention to provide a water uptake device for directing water flow into a moving boat from the water stream immediately surrounding the boat's hull that allows the volume and pressure of the water flow entering the device to be adjusted by an operator at the helm from full force to no flow. Another object of this invention is to provide a water uptake device for marine vessel applications that has a simple design and an easy-to-use means of water flow adjustment. It is also an object of this invention to provide a water uptake device for marine vessel applications that is made with non-corroding materials and durable construction for reliable operation without premature deterioration or failure. A further object of this invention is to provide a device for directing water flow into a boat that may have a break-away design to protect the associated boat hull from damage should the device make contact with a large or immovable underwater object. It is also an object of this invention to provide a device for directing water flow into a boat that has a scooping member that can be repeatedly and reliably lowered variable distances beyond the boat's hull while the boat is underway, according to operator preference or need, and then be completely and promptly retracted into the through-hull fitting housing it when no flow of water into the boat's hull is desired. In addition, it is an object of this invention to provide a device for directing water flow into a boat that has anti-rotation means for maintaining the opening in its deployable scooping member in the direction of forward boat movement, so that at any deployed position wherein the opening in the scooping member is at least partially exposed beyond the through-hull fitting's distal end and enters the water stream immediately surrounding the boat, the scooping member will draw the maximum possible water flow through the boat's hull.

The present invention, when properly made and used, provides a simple and low cost means for directing water flow into a boat from the water stream surrounding its hull, while the boat is moving in a forwardly direction through the water. It comprises a scooping member that is deployably housed within the longitudinal bore of a through-hull fitting secured to the boat's hull so that the distal end portion of the through-hull fitting is located outside the boat hull (preferably flush with the outside surface of the hull) and its center/middle portion and proximal end become located inside the boat hull. The deployable scooping member has a proximal end that remains positioned within the bore of the through-hull fitting during its use to direct water flow into a boat, and a distal end that can be repeatedly made to extend beyond the distal end portion of the through-hull fitting secured against and/or flush with the outside surface of the boat's hull. Furthermore, the proximal end of the scooping member is connected to a simple release mechanism that can be operated from the boat's helm and is able to produce varying amounts of deployment for the scooping member beyond the through-hull fitting, according to operator preference or need. Full retraction of the scooping member into the through-hull fitting is also an option when water flow into the boat is no longer needed. The volume and pressure of water flowing into a boat via the present invention can be regulated from full force to no flow at all by simple operator adjustment of the amount of the scooping member protruding beyond the distal end of the through-hull fitting and extending into the water stream surrounding the boat's hull. The release mechanism used for deployable adjustment of the scooping member can be varied and preferably includes cable, wire, and/or magnetic means, but is not limited thereto. The exterior surface of the proximal end portion of the through-hull fitting (located inside the boat hull) may also have an attachment-enhancing configuration for use in connecting independent plumbing that can be positioned and employed to direct water entering the through-hull fitting via the scooping member into the desired area of the boat, such as ballast bags or other types of fluid containers. Preferred brass or stainless steel materials for the through-hull fitting give it durable and reliable construction. The same materials can be used for the present invention scooping member, unless a break-away construction is desired. Then, plastic materials could be substituted. Multiple present invention scooping devices can be used on the same marine vessel, with all devices mounted on the bottom of its hull in a standard fashion for through-hull fittings mounted below the waterline. To maintain the present invention scooping member in a position where its distal end opening is oriented for maximum water flow into the associated boat, a keying component may be used, or in the alternative (or in combination therewith), the configurations of the inside wall of the bore in the through-hull fitting and the slightly smaller exterior surface of the scooping member may comprise other means to prevent rotation of the scooping member within the bore, such as but not limited to, angled geometric configurations (such as those of a hexagon or octagon), or geometric configurations having more than one diameter dimension (such as those of an oval or ellipse). With its few parts, simple construction, simple operation, low cost manufacture and installation (when compared to the cost involved for installing and using an electrically operated centrifugal pump), and anti-rotational design features, the present invention provides a benefit for boaters.

The description herein provides preferred embodiments of the present invention but should not be construed as limiting its scope. For example, variations in the size of the water-intake opening in the scooping member; the length dimension of the through-hull fitting; the length dimension of the scooping member; the presence, location, and configuration of attachment-enhancing features on the exterior surface of the proximal end portion of the through-hull fitting; and the materials from which the through-hull fitting and scooping member are made, other than those shown and described herein, may be incorporated into the present invention. Thus, the scope of the present invention should be determined by the appended claims and their legal equivalents, rather than being limited to the examples given.

DETAILED DESCRIPTION OF THE INVENTION

Figure 1:
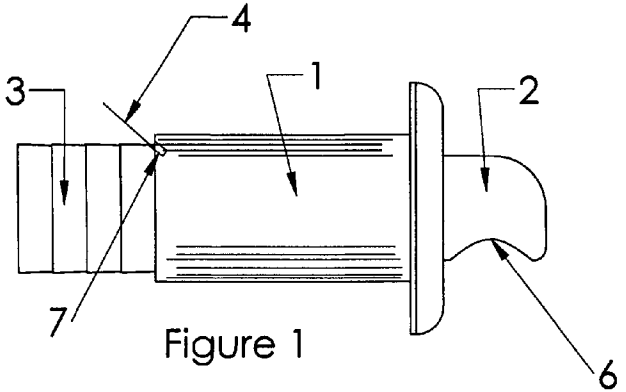
FIG. 1 is a side view of the most preferred embodiment of the present invention with the distal end of its scooping member in its deployed state and extending beyond the end of the through-hull fitting, as viewed from the side of a boat, and further with a wire or cable extending through an aperture in the through-hull fitting for connection to a control at the helm of the boat to provide a direct means by which an operator remaining at the helm can repeatedly move the scooping member from a fully retracted position into a fully deployed position, and the reverse, according to need.

The present invention provides a simple device for directing water flow into a boat 10 (See FIG. 7) while it is moving in a forwardly direction through the water. As shown in FIGS. 1-5, its most preferred embodiment comprises a scooping member 2 housed for deployable movement within the longitudinal bore 9 (shown in FIGS. 3 and 5) of a through-hull fitting 1 that is secured through the hull of a boat (represented by the number 10 in FIG. 7). It also comprises a simple release mechanism 4 (such as a cable or wire, but not limited thereto) having one of its opposed ends associated with the proximal end of the scooping member 2 for use in repeatedly deploying the distal end of scooping member 2 beyond the distal end portion of the through-hull fitting 1 and into the water stream immediately surrounding boat 10 to direct water flow into it. Release mechanism 4 extends through an aperture 7 in through-hull fitting 1 (shown in FIG. 1), and is also used to retract scooping member 2 back into longitudinal bore 9 to stop water entry into boat 10 via through-hull fitting 1. The opposed end of release mechanism 4 is preferably positioned for use in remote deployment of scooping member 2 by the boat's operator (not shown) from the helm.

Figure 2:
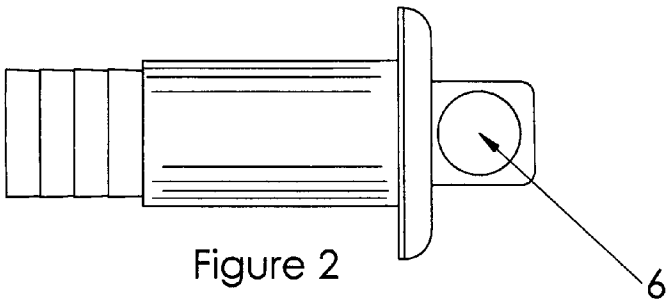
FIG. 2 is a front view of the most preferred embodiment of the present invention with the distal end of its scooping member in its deployed state and extending beyond the end of the through-hull fitting, as viewed from the front of the boat.
Figure 3:
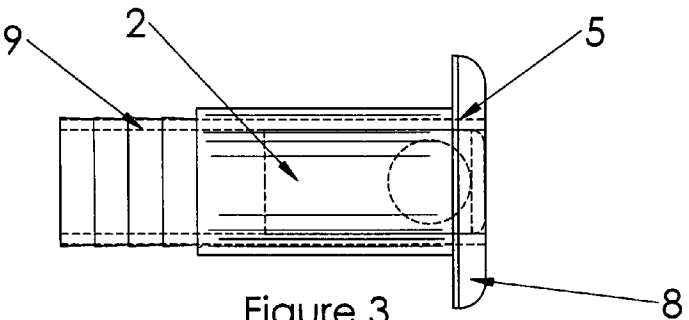
FIG. 3 is a front view of the most preferred embodiment of the present invention when its scooping member is not deployed beyond the distal end portion of the through-hull fitting, with broken lines illustrating an outline of the scooping member, the water-diverting distal end opening in the scooping member, the longitudinal bore of the through-hull fitting, and the keying feature preventing rotation of the scooping member within the bore.
Figure 4:
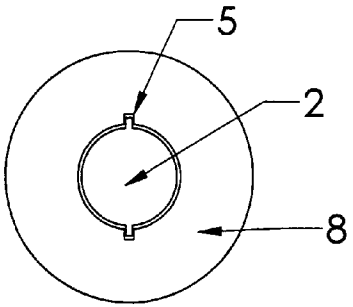
FIG. 4 is an end view of the most preferred embodiment of the present invention as it would be viewed by an observer looking up at the bottom of the hull, with an anti-rotation keying feature shown that prevents the scooping member from rotating relative to the through-hull fitting so that the scooping member is always deployed with its water-diverting distal end opening fully facing the water flow around the boat's hull to bring the maximum water flow possible into the boat for the amount of scoop deployment provided.
Figure 5:
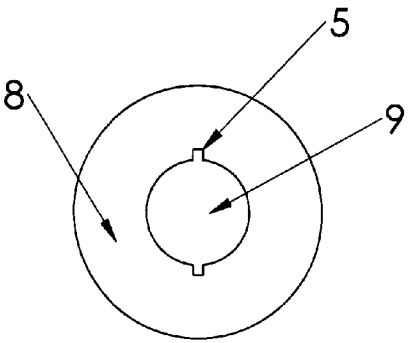
FIG. 5 is an end view of the through-hull fitting in the most preferred embodiment of the present invention, with the anti-rotation keying feature shown and no scooping member present within its central longitudinal bore.

FIGS. 1-4 show the most preferred embodiment of the present invention from varying angles, and with scooping member 2 shown in its deployed state in FIGS. 1 and 2, and non-deployed in FIG. 3. In contrast, FIG. 5 shows through-hull fitting 1 without scooping member 2 present within its longitudinal bore 9. FIG. 1 is a side view of the most preferred embodiment of the present invention with scooping member 2 in a deployed state with its distal end extending beyond the distal end portion 8 of the through-hull fitting 1, as viewed from the side of boat 10. FIG. 1 could represent a fully deployed scooping member 2, but is not limited thereto. In contrast, FIG. 2 is a front view of the most preferred embodiment of the present invention with scooping member 2 in its deployed state and its distal end extending beyond the distal end portion 8 of the through-hull fitting 1, as viewed from the front of boat 10. FIG. 2 also reveals the proportionally large water-diverting opening 6 associated with the distal end of scooping member 2 that is preferred. FIG. 3 is a front view of the most preferred embodiment of the present invention when scooping member 2 is not deployed and no water at all will flow into the associated boat 10 via through-hull fitting 1. FIG. 4 is an end view of the most preferred embodiment of the present invention as it would be viewed by an observer looking up at the bottom of a boat's hull, with an anti-rotation keying feature 5 shown that prevents scooping member 2 from rotating relative to through-hull fitting 1 so that scooping member 2 is always deployed with its water-diverting distal end opening 6 fully facing the water flow around the boat's hull to bring the maximum water flow possible into boat 10. FIG. 5 is an end view of through-hull fitting 1 without scooping member 2 present within its longitudinal bore 9, wherein only the distal end portion 8 of through-hull fitting 1, its longitudinal bore, and the keying feature 5 communicating with bore 9 are visible.

As shown in FIGS. 1-3, through-hull fitting 1 (numerically marked only in FIG. 1) has a distal end portion 8 (numerically marked in FIGS. 3 and 5) in an opposed position to its proximal end portion 3 (numerically marked only in FIG. 1), with a middle portion (not numerically marked, but visible in FIGS. 1-3) therebetween that houses scooping member 2 when in its non-deployed state (illustrated in FIG. 3). The relative length and diameter dimensions of the distal end portion 8 and proximal end portion 3 of through-hull fitting 1, as well as the middle portion therebetween, is not limited to that shown in FIGS. 1-3. Furthermore, although not shown, any portion or all of the exterior surface of the middle portion of through-hull fitting 1 between its proximal end portion 3 and its distal end portion 8 can include a threaded configuration or other attachment-enhancing means adapted to assist in its secure and leak-proof connection to the hull of boat 10 below the water line. As shown in FIGS. 1-3, the proximal end portion 3 of through-hull fitting 1 has an attachment-enhancing configuration that can be used to assist in the connection of independent plumbing (not shown) thereto, which is configured and positioned to direct the water entering the opening 6 in the distal end of scooping member 2 into a desired area of boat 10, such as but not limited to ballast bags or a container used for bait (not shown). However, although the attachment-enhancing configuration of the proximal end portion 3 of the through-hull fitting 1 shown in. FIGS. 1-3 is preferred, it may be different from that shown. Similarly, although the configuration of the distal end portion 8 of the through-hull fitting 1 shown in FIGS. 1-5 is preferred, it may have a flange radially-extending from its perimeter edge or be different in some other way from the configuration shown. Furthermore, the location of the aperture 7 extending through the side of through-hull fitting 1 is merely representative in FIG. 1, and its relative size and positioning may be different from that shown. Also, the means of connection for one of the opposing ends of release mechanism 4 to scooping member 2 at or near its proximal end is not shown, and can be by any means that allows for reliable and reproducible remote deployment of scooping member 2 by an operator at the helm. In addition, the size and configuration of the water-diverting opening 6 in scooping member 2 may vary from that shown in FIGS. 1-3, although a relatively large opening 6 is preferred for most applications. Broken lines in FIG. 3 show the scooping member 2 in a retracted state, which could be showing scooping member 2 as it would be in a fully retracted state. However, although the positioning shown in FIG. 3 is the preferred fully retracted configuration of scooping member 2, FIG. 3 is merely representative of a retracted state and the exact positioning shown therein should not be considered as limiting. When scooping member 2 is in its fully retracted state within bore 9, no water enters boat 10 via through-hull fitting 1. As marked by the arrow associated with the number 9, bore 9 is also illustrated via broken lines in FIG. 3. The female keying feature 5 communicating with bore 9 is also shown in broken lines in FIG. 3, with the un-numbered male structure on the outside surface of scooping member 2 (that is complementary to female keying feature 5) being shown by broken lines having slightly longer line segments that the other broken lines around it. Since shading obscures most of the male keying structure on one side of scooping member 2, the longer broken lines in FIG. 3 are clearly visible only on a single side of scooping member 2.

Figure 6:
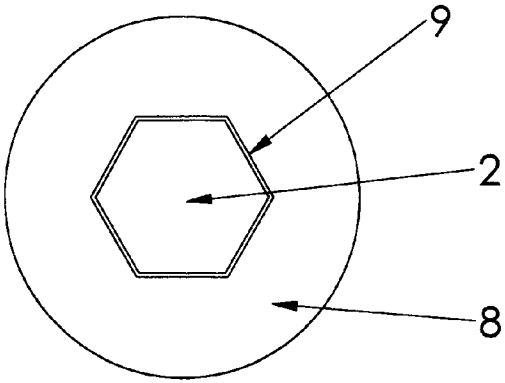
FIG. 6 is an end view of the most preferred embodiment of the present invention as it would be viewed by an observer looking up at the bottom of the hull, with its scooping member shown having a hexagonal cross-sectional configuration that prevents it from rotating relative to the through-hull fitting so that the scooping member is always deployed with its water-diverting distal end opening fully facing the water flow around the boat's hull to bring the maximum water flow possible into the boat for the amount of scoop deployment provided.

FIGS. 4 and 5 respectively show an end view of through-hull fitting 1 with scooping member 2 located in its bore 9, and an end view of through-hull fitting 1 without scooping member 2 located in its bore 9. Thus, the female keying feature 5 communicating with bore 9 is shown in FIGS. 4 and 5, while the complementary male keying structure on the outside surface of scooping member 2 is only shown clearly in FIG. 4. As shown in FIG. 6, in the alternative two keying features 5 are shown in FIG. 4, in positions opposed to one another on opposite sides of scooping member 2, only the uppermost keying feature 5 is numerically marked. The small rectangle positioned between each keying feature 5 and scooping member 2 represents the male keying structure on scooping member 2 that is complementary to keying feature 5 and prevents rotation of scooping member 2 relative to through-hull fitting 1 for maximum water inflow during scooping member deployment. While one keying feature 5 may be sufficient to prevent rotation of scooping member 2 within bore 9, and two keying features 5 are shown in FIGS. 4 and 5, more than two keying features 5 are also considered to be within the scope of the present invention. In addition, when two keying features 5 are used, the opposed positioning of keying features 5 shown in FIG. 4 is not critical. Furthermore, although not shown, in the alternative or in addition to keying feature 5, means to prevent the rotation of scooping member 2 relative to through-hull fitting 1 can also comprise a change in the configuration of bore 9 from that of a circle to that of an angled polygon (such as an octagon or hexagon, although not limited thereto) or that of a geometric configuration having more than one diameter dimension (such as that of an oval or ellipse).

Although in FIGS. 1-3 the extendable scooping member 2 of the present invention is only shown in its fully deployed and non-deployed states, it is also deployable into a variety of positions between its fully extended state relative to through-hull fitting 1 and its fully retracted state (shown in FIG. 3) wherein scooping member 2 is withdrawn fully into the longitudinal bore 9 of through-hull fitting 1 and no water at all can flow into the boat via through-hull fitting 1. Water flow volume and pressure can be adjusted from full force to no flow at all by simple operator adjustment (using release mechanism 4) of the amount of scooping member 2 extending beyond through-hull fitting 1 and entering the water stream immediately surrounding the hull of boat 10. Further, it is preferred for the various deployed positions of scooping member 2 relative to through-hull fitting 1 to be remotely determined by the boat's operator from the helm. The release mechanism 4 used for deploying scooping member 2 in the most preferred embodiment of the present invention is associated with the proximal end of the deployable scooping member 2 and would extend through an aperture 7 centrally in side of through-hull fitting 1, typically above the position where the proximal end of scooping member 2 resides when in its fully retracted state. The release mechanism 4 used for deploying and retracting scooping member 2 in the most preferred embodiment of the present invention can include, a cable, wire, or magnetic means, but it is not limited thereto. Furthermore, in the alternative, release mechanism 4 can comprise one cable or wire extending from the boat's helm to scooping member 2, or include an assembly of components that reliably and repeatedly deploys scooping member 2 from through-hull fitting 1, and then retracts it again (fully or partially) into through-hull fitting 1 according to operator preference and/or need.

Preferred brass and stainless steel materials for through-hull fitting 1 contribute to the durable construction of the present invention scooping device. However, materials for scooping member 2 should be sufficiently strong to divert water into the through-hull fitting when the associated boat is traveling through the water, but the materials used could also allow scooping member 2 to break away from its associated through-hull fitting 1 when scooping member 2 makes sufficiently strong contact with a large or immovable underwater object that without the break-away configuration could otherwise lead to hull damage. If scooping member 2 is made from a plastic material, such as polyvinyl chloride (PVC), scooping member 2 would be easily and inexpensively replaceable should it become damaged due to underwater contact with an immovable object (not shown). Furthermore, in the most preferred embodiment of the present invention, the distal end portion 8 of through-hull fitting 1 would be preferably mounted flush with the outside surface of the hull of boat 10, although not limited thereto. With its few parts and anti-rotational design feature that can result from the use of complementary slip-resistant geometric and other configurations (such as hexagonal, oval, or elliptical) for the longitudinal bore 9 in through-hull fitting 1 and the external surface of scooping member 2, and/or keying components 5, the present invention provides simple and durable construction for cost effective manufacture and use.

Figure 7:
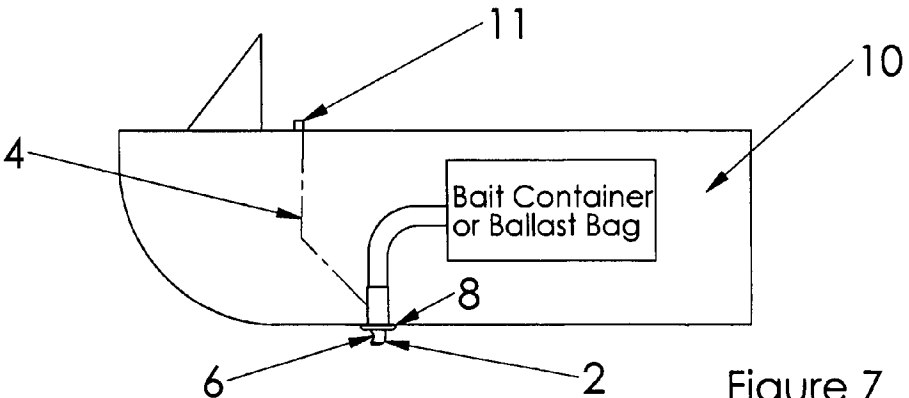
FIG. 7 is a side view of a boat having one of the most preferred embodiments of the present invention secured through the bottom of its hull, with the through-hull fitting connected via tubing to a ballast bag, and the scooping member connected via a mechanical release mechanism to a control at the helm of the boat.

The words 'boat' and 'marine vessel' have been interchangeably used in this invention disclosure, however, it should be noted that the word 'boat' was used more frequently without any intent of limitation. Component 1 is a standard through-hull fitting with a longitudinal bore 9, which has been modified with aperture 7 and keying feature 5 for housing deployable scooping member 2 within bore 9 without rotation of scooping member 2 within bore 9. As shown in FIG. 7, it is contemplated for through-hull fitting 1 to be mounted on the bottom of a boat hull 10, in a standard fashion for through-hull fittings mounted below the waterline. Component 2 is a water scooping member having a hollow interior communicating with an opening 6 in its distal end that is fixed in its relation to through-hull fitting 1 to always be deployed in a position that fully faces the forwardly direction of boat 10 travel. Thus, as the boat 10 travels forward, water is taken into opening 6, and re-directed into the through-hull fitting 1. Component 3 is the proximal end portion of through-hull fitting 1, typically having attachment-enhancing external structure used for the connection of independent plumbing (not shown) that directs water flow from through-hull fitting 1 to its final destination in boat 10, such as a ballast bag or bait container (not shown). Component 4 is a release mechanism 4 connected to the proximal end of scooping member 2 that an operator (not shown) can access from the helm to pull scooping member 2 up into the longitudinal bore 9 of through-hull fitting 1 to stop water flow into boat 10, or extend scooping member 2 into one of many deployed positions between its fully extended/deployed state and its fully retracted state. Component 5 is a keying feature that prevents scooping member 2 from rotating relative to through-hull fitting 1, which is particularly important when scooping member 2 is deployed beyond the distal end of through-hull fitting 1 so as to place the water-diverting opening 6 fully in the water stream surrounding boat 10. Keying feature 5 may consist of one or more protrusions (elsewhere herein referred to as male keying members) on scooping member 2 with corresponding notches (elsewhere herein referred to as female keying members and always having the numerical designation of 5 in the accompanying illustrations) in through-hull fitting 1 (as shown in FIGS. 3-5), and/or complementary polygonal configurations (such as but not limited to the hexagon shown in FIG. 6) or other shapes (such as but not limited to oval or elliptical) that would provide an anti-rotational benefit for the bore 9 of through-hull fitting 1 and the slightly smaller external surface of scooping member 2. Component 6 is the relatively large opening on the distal end of scooping member 2 that faces the forward direction of boat movement and is used to direct water adjacent to the boat's hull into the boat via through-hull fitting 1.

FIG. 6 is an end view of the most preferred embodiment of the present invention as it would be viewed by an observer looking up at the bottom of a boat's hull, with its scooping member 2 shown having an angular cross-sectional configuration that prevents it from rotating relative to the through-hull fitting 1 so that the scooping member is always deployed with its water-diverting distal end opening fully facing the water flow around the boat's hull to bring the maximum water flow possible into the boat (such as boat 10 in FIG. 9) for the amount of scoop deployment provided.

What is claimed is:

1. A water uptake device mounted on a hull of a marine vessel, the uptake device configured to bring water into the hull of the marine vessel moving forwardly through water, said device comprising:

a through-hull fitting secured through a bottom surface of the hull of the marine vessel, the fitting having a longitudinal bore extending between a proximal end portion and a distal end portion, and an aperture communicating with said longitudinal bore;

a scooping member with a proximal end positioned within said longitudinal bore and a distal end, said scooping member further having a water-intake opening on one side of said distal end, wherein the water-intake opening is oriented in the direction of a forward motion of the marine vessel;

orientation stabilizing structure adapted to maintain said scooping member in non-rotating orientation relative to said through-hull fitting and to keep said water-intake opening in said distal end of said scooping member always facing in the direction of said forward motion of the marine vessel; and remote deployment mechanism adapted for remotely moving said scooping member between a fully retracted state and a fully deployed state, wherein in said fully retracted state said water-intake opening is not exposed beyond said distal end portion of said through-hull fitting, and wherein in said fully deployed state relative to said through-hull fitting said water-intake opening in said scooping member is fully exposed beyond said distal end of said through-hull fitting, whereby said scooping member is deployably positioned within said longitudinal bore so as to allow said distal end of said scooping member to protrude beyond said distal end portion of said through-hull member, said proximal end portion of said through-hull fitting being connected via independent plumbing to a fluid receiving container in the marine vessel, remote activation of said remote deployment mechanism moving said scooping member from said fully retracted state where no water enters said scooping member to said fully deployed state wherein said distal end of said scooping member enters the water stream immediately surrounding the marine vessel and allows maximum water flow into said water-intake opening in said scooping member, and movement thereafter of the water flow into the fluid receiving container in the marine vessel, said remote deployment mechanism capable of positioning the scooping member in an intermediate position between said fully deployed state and said fully retracted state, thereby regulating protrusion of said scooping member beyond said distal end portion of said through-hull fitting into the water stream surrounding the marine vessel and a corresponding adjustment in the volume and pressure of the water flow entering said water-intake opening in said scooping member.

2. The device of claim 1 wherein said scooping member has a break-away configuration that allows it to prevent damage to the marine vessel hull should said scooping device hit an immovable underwater object.

3. The device of claim 1 wherein said scooping member does not have a break-away configuration.

4. The device of claim 1 wherein said remote deployment mechanism for deployment of said scooping member is operable from the marine vessel's helm.

5. The device of claim 1 wherein said water-intake opening in said distal end of said scooping member is enlarged.

6. The device of claim 1 wherein said aperture is formed through said proximal end portion of said through-hull fitting.

7. The device of claim 1 wherein said orientation stabilizing structure comprises a keying feature.

8. The device of claim 1 wherein said orientation stabilizing structure comprises complementary geometric configurations for said longitudinal bore and said scooping member that are selected from a group consisting of angled geometric configurations and geometric configurations having more than one diameter dimension.

9. A method of water uptake using the water uptake device and the marine vessel of claim 1, said method comprising the steps of:

providing an attachment mechanism adapted for watertight connection of said through-hull fitting to said hull, independent plumbing, a fluid receiving container, and a body of water;

using said attachment mechanism to mount said through-hull fitting on said bottom of said marine vessel's hull;

associating said remote deployment mechanism with said proximal end of said scooping member;

positioning said scooping member for longitudinal movement within said longitudinal bore of said through-hull fitting so that said distal end of said scooping member is able to move between a fully retracted state within said longitudinal bore to a fully deployed state wherein said water-intake opening in said distal end of said scooping member protrudes in its entirety beyond said distal end portion of said through-hull fitting;

placing said fluid receiving container within said marine vessel's hull;

connecting said independent plumbing between said proximal end portion of said through-hull fitting and said fluid receiving container so as to provide fluid communication therebetween;

placing said marine vessel in said body of water so that said marine vessel moves in a forwardly direction in said body of water and said bottom of said marine vessel's hull is in contact with said body of water; and activating said remote deployment mechanism while said marine vessel is moving in a forwardly direction to cause longitudinal movement of said scooping member within said through-hull fitting whereby said scooping member is able to move from said fully retracted state where no water enters said scooping member into said fully deployed state wherein said distal end of said scooping member enters said body of water immediately surrounding said marine vessel and causes maximum water flow into said water-intake opening in said scooping member, with subsequent movement of the water flow into said fluid receiving container in said marine vessel's hull, whereby said scooping member is able to move back into said retracted state within said longitudinal bore of said through-hull fitting, and further whereby movement of said scooping member into other positions between said fully deployed state and said fully retracted state adjusts the volume and pressure of the water flow entering said water-intake opening in said scooping member from full force to no flow at all simply by the amount of said scooping member that protrudes beyond said distal end portion of said through-hull fitting into said body of water surrounding said marine vessel.

10. The method of claim 9 wherein said scooping member has a break-away configuration that allows it to prevent damage to said marine vessel hull should said scooping device hit an immovable underwater object.

11. The method of claim 9 wherein said scooping member does not have a break-away configuration.

12. The method of claim 9 wherein said remote deployment mechanism for deployment of said scooping member is operable from the marine vessel's helm.

13. The method of claim 9 wherein said water-intake opening in said distal end of said scooping member is enlarged.

14. The method of claim 9 wherein said aperture is formed through said proximal end portion of said through-hull fitting.

15. The method of claim 9 wherein said orientation stabilizing structure comprises a keying feature.

16. The method of claim 9 wherein said orientation stabilizing structure comprises complementary geometric configurations for said longitudinal bore and said scooping member selected from a group consisting of angled geometric configurations and geometric configurations having more than one diameter dimension.

17. The method of claim 9 wherein the order of said step of associating said remote deployment mechanism with said proximal end of said scooping member and said step of positioning said scooping member for longitudinal movement within said longitudinal bore of said through-hull fitting can be reversed.

18. The method of claim 9 wherein the order of said step of placing said marine vessel in said body of water can occur at any time prior to said step of activating said remote deployment mechanism.

19. The method of claim 9 wherein the order of said step of using said attachment mechanism to mount said through-hull fitting on the bottom of said marine vessel's hull can occur at any time after said step of associating said remote deployment mechanism with said proximal end of said scooping member as long as it occurs before said step of activating said remote deployment mechanism.

20. The method of claim 9 wherein the order of said step of connecting said independent plumbing can occur at any time after said step of positioning said scooping member for longitudinal movement within said longitudinal bore of said through-hull fitting as long as it occurs before said step of activating said remote deployment mechanism.

* * * * *